US011009815B2

(12) United States Patent
Matsuzaki et al.

(10) Patent No.: US 11,009,815 B2
(45) Date of Patent: May 18, 2021

(54) IMAGE FORMING APPARATUS WITH CONTROL OF POWER TO TRANSFER ROLLER

(71) Applicant: CANON KABUSHIKI KAISHA, Tokyo (JP)

(72) Inventors: Kenta Matsuzaki, Noda (JP); Shozo Aiba, Tsukubamirai (JP); Tomohiro Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/723,344

(22) Filed: Dec. 20, 2019

(65) Prior Publication Data

US 2020/0209785 A1 Jul. 2, 2020

(30) Foreign Application Priority Data

Dec. 28, 2018 (JP) ..... JP2018-248743

(51) Int. Cl.
*G03G 15/16* (2006.01)

(52) U.S. Cl.
CPC ..... *G03G 15/168* (2013.01); *G03G 15/161* (2013.01); *G03G 15/1675* (2013.01); *G03G 2215/0177* (2013.01); *G03G 2215/1657* (2013.01)

(58) Field of Classification Search
CPC ..... G03G 15/1605; G03G 15/168; G03G 15/1675; G03G 2215/1657; G03G 2215/1652
See application file for complete search history.

(56) References Cited

U.S. PATENT DOCUMENTS

| | | | | |
|---|---|---|---|---|
| 5,179,397 | A | 1/1993 | Ohzeki et al. | |
| 5,253,022 | A | 10/1993 | Takeuchi et al. | |
| 6,266,495 | B1 * | 7/2001 | Yuminamochi .... | G03G 15/1675 399/314 |
| 2017/0351200 | A1 * | 12/2017 | Matsuzaki ..... | G03G 15/168 |
| 2019/0179239 | A1 | 6/2019 | Minato | |

FOREIGN PATENT DOCUMENTS

| | | | |
|---|---|---|---|
| JP | 02-264278 | A | 10/1990 |
| JP | 2005-316200 | A | 11/2005 |
| JP | 2017-125993 | A | 7/2017 |
| JP | 2017-125995 | A | 7/2017 |
| JP | 2018-036625 | A | 3/2018 |

OTHER PUBLICATIONS

English machine translation of JP 2017-125993 (Year: 2017).*

* cited by examiner

*Primary Examiner* — Arlene Heredia
(74) *Attorney, Agent, or Firm* — Venable LLP

(57) ABSTRACT

An image forming apparatus includes an image bearing member, a transfer roller, an electric energy supply member, a voltage source, a detector, and a controller for adjusting a transfer voltage. A circumferential length 2K of the transfer roller and a distance k measured along an outer periphery of the transfer roller from the electric energy supplying member to the transfer roller satisfy $0.8K \leq k \leq 1.2K$. The controller controls the voltage source so as to satisfy $0.7T \leq t \leq 1.3T$, where 2T is time required for one full rotation of the transfer roller, and t is time during which the voltage source supplies the test current or the test voltage per one level in the operation of a setting mode.

6 Claims, 8 Drawing Sheets

IMAGE FORMING APPARATUS WITH CONTROL OF POWER TO TRANSFER ROLLER

FIELD OF THE INVENTION AND RELATED ART

The present invention relates to an image forming apparatus such as a copying machine, a printer, a facsimile machine, a printing apparatus using an electrophotographic type process or an electrostatic recording system, or a multifunction machine having a plurality of functions thereof.

Heretofore, in an image forming apparatus using an electrophotographic method, a toner image is transferred from an image bearing member such as a photosensitive member or intermediary transfer member to a recording material such as paper, and this toner image is fixed on the recording material, by which an image is formed as a print. The transfer of the toner image onto a recording material is often performed by applying a transfer voltage to a transfer member which forms a transfer portion in contact with the outer peripheral surface of the image bearing member. In addition, as the transfer member, a transfer roller that is a roller-shaped transfer member is often used.

A known transfer roller has a conductive shaft core, and an outer peripheral layer provided on the outer periphery of the shaft core, an ionic conductive agent is dispersed in the outer peripheral layer, by which appropriate conductivity is provided.

It is known that a transfer roller using an ionic conductive agent is easily affected by an environmental condition such as the ambient temperature. Under the circumstances, as disclosed in JP-A-2-264278, an ATVC control (Active Transfer Voltage Control) as transfer voltage control is known, in the transfer voltage is adjusted so that the optimal transfer current flows through the transfer roller, regardless of fluctuations in the electrical resistance of the transfer roller. That is, it applies a constant current controlled voltage to the transfer roller with a predetermined current value, on the basis of the voltage generated at that time, and the transfer voltage applied by constant-voltage-control during transfer is set. In ATVC control, the current-voltage characteristics are acquired by repeating voltage measurement using multiple levels of current values, in many cases. In addition, in ATVC control, to reduce the influence of uneven electrical resistance in the circumferential direction of the transfer roller, the transfer voltage is set on the basis of an average value of the voltages when a predetermined current is applied for a time longer than one full-turn of the transfer roller for each level. In addition, in general, the ATVC control is executed in the pre-rotation process at the start of the job of the image formation.

In addition, as described above, for the transfer roller using an ionic conductive agent, the electrical resistance thereof is easily affected by the environment such as the ambient temperature. Therefore, in the case of continuously forming images on multiple recording materials, the transfer voltage providing the optimal transfer current may change due to environmental changes such as ambient temperature. under the circumstances, in order to assure a transfer voltage which provides an optimal transfer current to flow during continuous image formation, the ATVC control as described above may correct the transfer voltage in the so-called inter-sheet process, which corresponds between adjacent recording materials contiguously fed. If the time period between the adjacent sheets is so short that the time period for one or more full rotation of the transfer roller cannot be assured, the transfer voltage is corrected on the basis of an average value of the voltages detected in the multiple inter-sheet periods, by which the influence of uneven electrical resistance in the circumferential direction of the transfer roller is reduced. If an attempt is made to effect the detections in multiple levels in the inter-sheet periods, the detection has to be performed in multiple inter-sheet periods for each level, and it is necessary to average the detection results corresponding to one full rotation of the transfer roller detected in multiple inter-sheet periods, for each level.

Here, in general, the ATVC control which is executed in the pre-rotation process at the start of a job is called "normal ATVC control", and the ATVC control executed in the inter-sheet period is called "inter-sheet ATVC control"

Here, in the transfer roller using the ionic conductive agent, the electrical resistance may increase with the tenderization time by applying the transfer voltage with the result of the ionic conductive agent being biased (polarized) to the outer surface side or the axial center side of the outer peripheral layer. And, when increasing the absolute value of the transfer voltage, the transfer roller must be replaced, before the output voltage exceeds the power capacity, in accordance with the increase in electrical resistance to apply the necessary transfer voltage. Therefore, the polarization of the ionic conductive agent may be a factor which shortens the life of the transfer roller. JP-A-2005-316200 proposes, against the problem, that a power supply roller which contacts the surface of the transfer roller is provided, and the transfer voltage is applied to the transfer roller by way of the power supply roller, by which an increase in electrical resistance of the transfer roller due to the polarization of the ionic conductive agent is suppressed.

As described above, the normal ATVC control is ordinarily executed in a pre-rotation process at the start of a job. Therefore, normally, the ATVC control is attributable to a delay in FCOT (First Copy Output Time), which is the time from when an image formation start instruction is inputted until the first recording material on which an image is formed is outputted. under the circumstances, usually, in order to perform ATVC control in as quickly as possible, it will be considered to repeat multiple times to detection of the voltage when a predetermined current is applied over a period of one or more full rotations of the transfer roller, by which a current-voltage characteristic of the transfer roller expressed by a linear function formula is acquired. However, even in this case, in order to reduce the influence of uneven electrical resistance in the circumferential direction of the transfer roller, the detection time is long enough to correspond to more than one full rotation of the transfer roller to acquire the detection result for each level, and therefore, more than two rotations of the transfer roller are required in total. In addition, the current-voltage characteristics of the transfer roller may have a quadratic relationship, and in such a case if the transfer voltage setting value based on the current-voltage characteristics expressed by the linear function obtained from the two levels of detection results is used, the voltage may deviate from the optimum voltage value. In addition, the prediction of the output possible bias voltage value of the high-voltage transformer may deviate, and a limiter voltage value in the limiter control of the upper limit value and a lower limit value of the transfer voltage may not be obtained accurately. Therefore, it is desirable to obtain the current-voltage characteristics expressed by a quadratic or higher function from the detection results of three or more levels, but in this case, a detection time corresponding to at least three full rotations of the transfer roller is required.

In addition, for inter-sheet ATVC control, in the conventional method of reducing the influence of the electrical resistance unevenness in the circumferential direction of the transfer roller based on the average value of the detection results in a plurality of inter-sheet processes when the inter-sheet process time is short, the influence of uneven electrical resistance in the circumferential direction of the transfer roller cannot be sufficiently reduced in some cases. In addition, in such a conventional method, when performing multiple levels of detection in the inter-sheet processes, the detection time in the inter-sheet process required for each level is long. On the other hand, it is possible to extend the inter-sheet period to reduce the influence of uneven electrical resistance in the circumferential direction of the transfer roller, but also in this case, the required detection time is longer. In inter-sheet ATVC control, the toner (fog toner) which may have adhered to the area between the sheet on the image bearing member is positively attracted to the transfer roller by applying the voltage to the transfer roller. Therefore, if the detection time in the inter-sheet ATVC control is long, it may promote the occurrence of contamination on the back side of recording materials during subsequent image formation, in some cases, due to the fog toner adhering to the transfer roller.

SUMMARY OF THE INVENTION

An object of the present invention is to provide an image forming apparatus capable of improving the accuracy of transfer voltage control while shortening the time required for transfer voltage control.

According to an aspect of the present invention, there is provided an image forming apparatus comprising an image bearing member configured to carry a toner image; a rotatable transfer roller in contact with said image bearing member to form a transfer portion and configured to transfer the toner image from image bearing member onto a recording material which is passing through the image bearing member; an electroconductive member in contact with an outer peripheral surface of said transfer roller to provide a contact portion; a voltage source configured to supply a current to said transfer roller through a current path which is formed between said image bearing member and said electroconductive member through said transfer roller; a detector configured to detect a voltage at the time when a current is supplied from said voltage source, or to detect a current at the time when a voltage is supplied from said voltage source; and a controller configured to execute, in a non-image-transfer period, an operation in a setting mode, in which said voltage source supplies a predetermined test current or test voltage at one or more levels, said detector detects a voltage or a current at the time when the test current or the test voltage supplied, and on the basis of a result of detection of said detector, a voltage to be applied by said voltage source in an image transfer operation is set, wherein in a cross section substantially perpendicular to a rotational axis of said transfer roller, said electroconductive member satisfies $0.8K \leq k \leq 1.2K$, where 2K is a circumferential length of said transfer roller, and k is a distance measured along an outer periphery of said transfer roller from said electric energy supplying portion to said transfer portion, and wherein said controller controls said voltage source so as to satisfy $0.7\ T \leq t \leq 1.3\ T$, where 2 T is time required for one full rotation of said transfer roller, and t is time during which said voltage source supplies in the test current or the test voltage per one level in the operation of the setting mode.

Further features of the present invention will become apparent from the following description of exemplary embodiments with reference to the mounted drawings.

Figure 8:
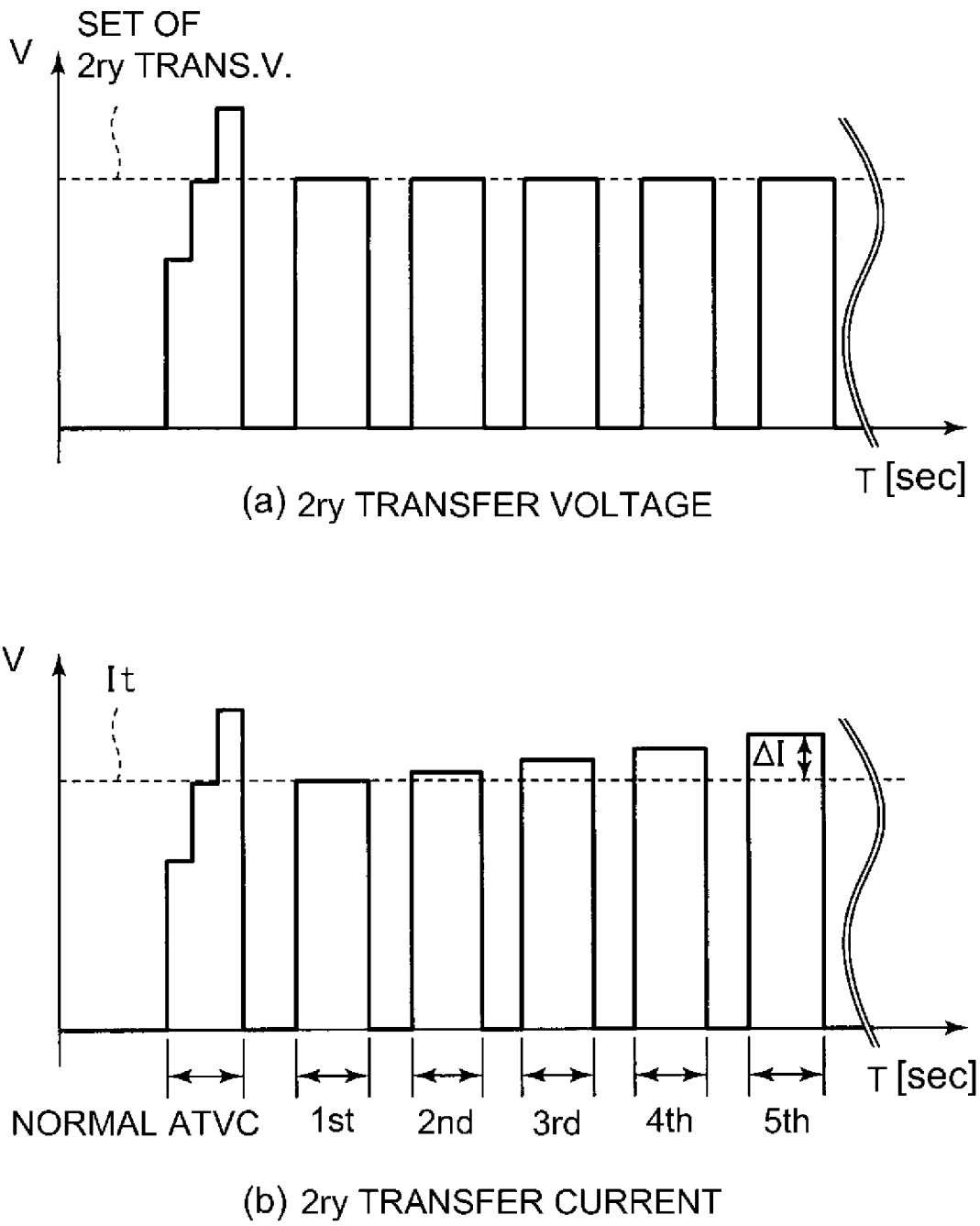

Parts (a) and (b) of FIG. 8 are graphs showing an example of a change of the secondary transfer current during continuous image forming operation.

Figure 9:
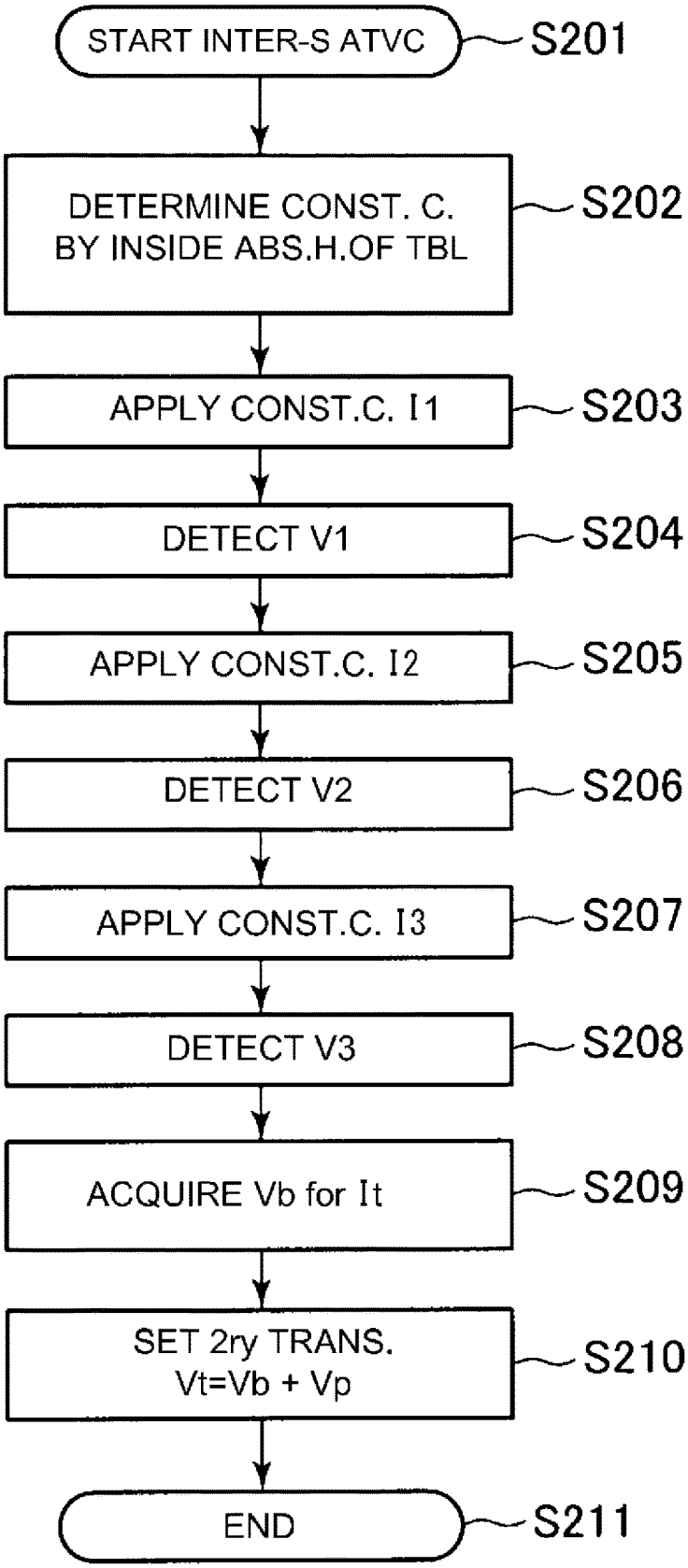

FIG. 9 is a flowchart showing an outline of the process of the inter-sheet ATVC control.

DESCRIPTION OF THE EMBODIMENTS

In the following, the image forming apparatus according to the present invention will be described in more detail with reference to the accompanying drawings.

Embodiment 1

1. General Arrangement and Operation of Image Forming Apparatus

Figure 1:
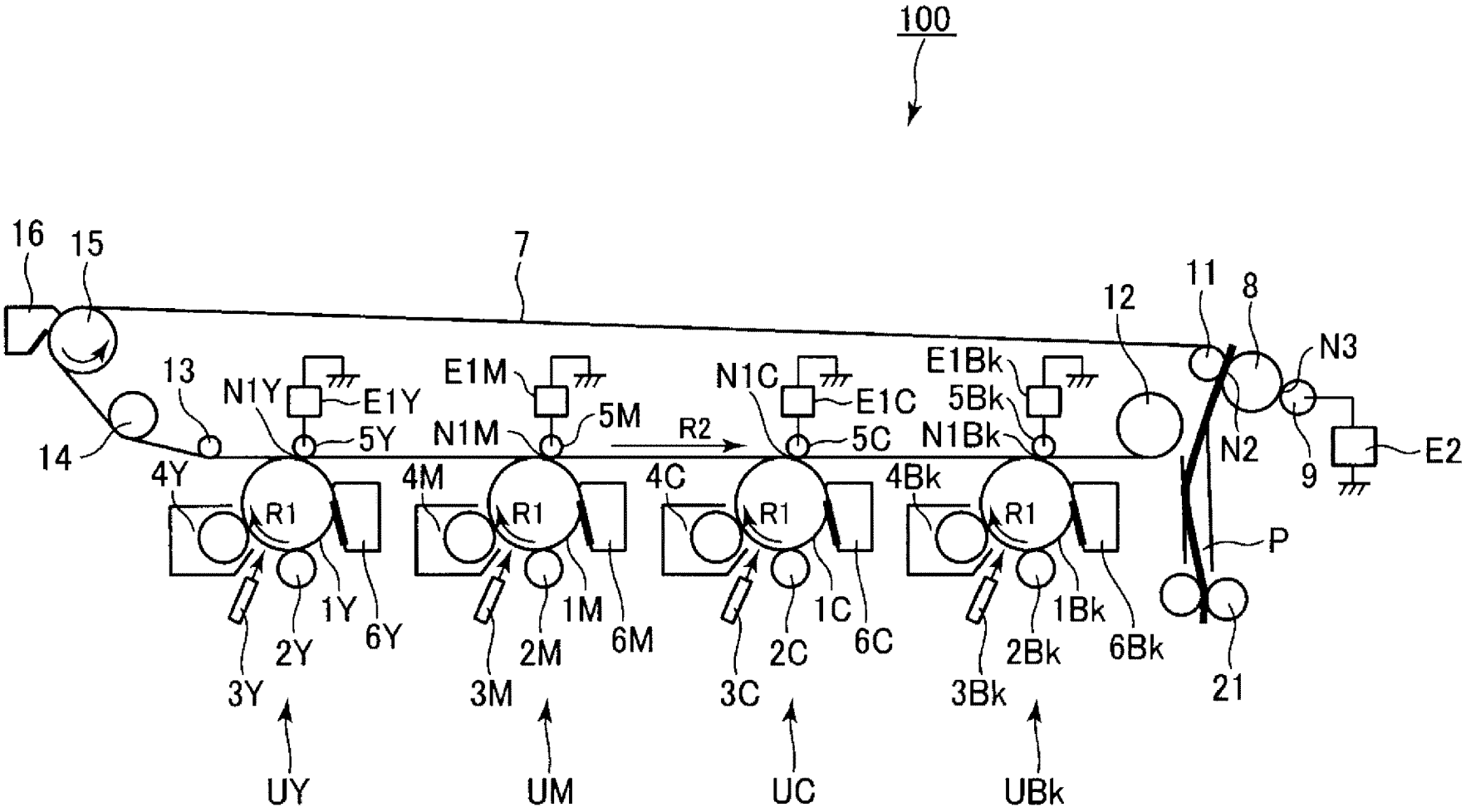
FIG. 1 is a schematic sectional view of an image forming apparatus.

FIG. 1 is a schematic cross-sectional view of an image forming apparatus 100 of this embodiment. The image forming apparatus 100 of this embodiment is a tandem type multi-function machine (which has the functions of a copying machine, a printer, and a facsimile machine) which employs an intermediary transfer system which can form a full-color image using an electrophotographic type process.

The image forming apparatus 100 includes four image forming units (stations) UY, UM, UC, and UBk which form yellow (Y), magenta (M), cyan (C), and black (Bk) images, respectively. The four image forming units UY, UM, UC, and UBk are arranged in a line at regular intervals along a moving direction of a surface of an intermediary transfer belt 7 which will be described hereinafter. For the elements having the same or corresponding structures or functions in each image forming unit UY, UM, UC, UBk, the suffixes Y, M, C, Bk at the end of the reference character may be omitted, which means that the description applies to all elements for different colors. In this embodiment, the image forming portion U includes a photosensitive drum 1, a charging roller 2, an exposure device 3, a developing device 4, a primary transfer roller 5, a drum cleaning device 6 and the like which will be described hereinafter.

The photosensitive drum 1, which is a drum-type (cylindrical) photosensitive member (electrophotographic photosensitive member) as a first image bearing member, is driven to rotate at a predetermined peripheral speed in a direction of arrow R1 (clockwise direction) in the Figure. The surface of the rotating photosensitive drum 1 is uniformly charged to a predetermined potential having a predetermined polarity (negative polarity in this embodiment) by the charging roller 2 which is a roller-shaped charging member as a charging means. In the charging process, a predetermined charging voltage (charging bias voltage) is applied to the charging roller 2 by a charging power source (not shown). The surface of the photosensitive drum 1 which has been charged is scanned and exposed to image light in accordance with image information by an exposure device 3 as an exposure means, so that an electrostatic image (electrostatic latent image) is formed on the photosensitive drum 1. In this embodiment, the exposure device 3 is a laser scanner device which deflects a laser beam modulated in accordance with image information along a longitudinal direction (rotational axis direction) of the photosensitive drum 1.

The electrostatic image formed on the photosensitive drum 1 is developed (visualized) by being supplied with toner by a developing device 4 as developing means, so that a toner image is formed on the photosensitive drum 1. In this embodiment, the developing device 4 is a two-component developing type developing device using a two-component developer mainly containing toner (non-magnetic toner particles) and carriers (magnetic carrier particles). The developing device 4 feeds the developer to a portion (developing portion) facing the photosensitive drum 1 by a developing sleeve as a rotatable developer carrying member. And, by applying a predetermined developing voltage (developing bias voltage) to the developing sleeve, the toner is transferred from the developer on the developing sleeve to the photosensitive drum 1 in accordance with the electrostatic image. In this embodiment, during the development process, a development voltage in which a negative DC voltage component and an AC voltage component are superimposed is applied to the development sleeve by a development power source. In addition, in this example, the charged toner adheres to the portion having the same polarity (negative polarity in this embodiment) as the charged polarity of the photosensitive drum 1, that is, to the exposed portion (image part) on the photosensitive drum 1 where the absolute value of the potential is lowered by the imagewise exposure after being uniformly charged (reverse development method). In this embodiment, the normal charging polarity of the toner, which is the charging polarity of the toner during development, is negative. the developing devices 4Y, 4M, 4C, and 4Bk contain toners of the colors of yellow, magenta, cyan, and black, respectively.

An intermediary transfer belt 7 which is an intermediary transfer member constituted by an endless belt as a second image bearing member is provided so as to face the four photosensitive drums 1Y, 1M, 1C, and 1Bk. The intermediary transfer belt 7 is wound around a plurality of tension rollers (support rollers), a driving roller 11, first, second, and third idler rollers 12, 13, 14, and a tension roller 15, and it is stretched by tension. In this embodiment, the driving roller 11 also serves as a secondary transfer counter roller which is a counter member (counter electrode) of a secondary transfer roller 8 which will be described hereinafter. By the driving roller (secondary transfer counter roller) 11 being driven to rotate, the driving force is transmitted to the intermediary transfer belt 7, and the intermediary transfer belt 7 rotates in a predetermined direction in the direction of an arrow R2 (counterclockwise direction) in the Figure, at a predetermined speed (circular movement). In this embodiment, the process speed of the image forming apparatus 100 (corresponding to the peripheral speed of the intermediary transfer belt 7) is 320 mm/sec. On the inner peripheral surface side of the intermediary transfer belt 7, a primary transfer roller 5 is provided corresponding to each photosensitive drum 1 as a roller-shaped primary transfer member as a primary transfer means. The primary transfer roller 5 is pressed toward the photosensitive drum 1 by way of the intermediary transfer belt 7 to form a primary transfer portion (primary transfer nip) N1 where the photosensitive drum 1 and the intermediary transfer belt 7 are in contact with each other. As described above, the toner image formed on the photosensitive drum 1 is primarily transferred onto the rotating intermediary transfer belt 7 in the primary transfer portion N1 by the action of the primary transfer roller 5. During the primary transfer process, the primary transfer roller 5 is supplied with a primary transfer voltage (primary transfer bias voltage) which is a DC voltage having a polarity opposite to the normal charging polarity of the toner (positive polarity in this embodiment), by primary transfer power supply E1. For example, when forming a full-color image, the yellow, magenta, cyan, and black toner images formed on the respective photosensitive drums 1 are sequentially primary-transferred so as to be superposed on the intermediary transfer belt 7 in the primary transfer portions N1.

On the outer peripheral surface side of the intermediary transfer belt 7, at the position facing the secondary transfer counter roller 11 which also serves as the driving roller, a secondary transfer roller 8 which is a roller-like secondary transfer member as a secondary transfer means is disposed. The secondary transfer roller 8 is pressed toward the secondary transfer counter roller 11 by way of the intermediary transfer belt 7, and the secondary transfer portion (secondary transfer nip) where the intermediary transfer belt 7 and the secondary transfer roller 8 are in contact with each other N2 is formed. As described above, the toner image formed on the intermediary transfer belt 7 is transferred onto a recording material (transfer material, sheet) P such as paper (paper) sandwiched and fed between the intermediary transfer belt 7 and the secondary transfer roller 8 by the action of the secondary transfer roller 8 in the secondary transfer portion N2. During the secondary transfer process, the secondary transfer roller 8 is supplied with a secondary transfer voltage (secondary transfer bias voltage) which is a DC voltage having a polarity opposite to the normal charging polarity of the toner (positive in this embodiment) by secondary transfer power supply E2. The recording material P is fed from a recording material accommodating portion (not shown) such as a recording material cassette, and it is fed to the registration roller pair 21 by a feeding roller (not shown) or the like. This recording material P is then fed to the secondary transfer portion N2 at the same timing as the toner image on the intermediary transfer belt 7 by registration roller pair 21. Here, in addition to paper, the recording material P may be a plastic sheet such as an OHP sheet, a synthetic paper made of a resin such as waterproof paper, or a cloth material.

The recording material P onto which the toner image has been transferred is fed to a fixing device (not shown) as fixing means. In the fixing device, in the process of nipping and feeding the recording material P at the fixing portion (fixing nip) between a fixing roller and a pressure roller, for example, the toner image is fixed (melted or fixed) on the recording material P by pressing and heating the recording material P carrying an unfixed toner image. The recording material P on which the toner image is fixed is discharged (outputted) to an outside of the main assembly of the image forming apparatus 100.

In addition, toner remaining on the photosensitive drum 1 without being transferred onto the intermediary transfer belt 7 during primary transfer (primary untransferred residual toner) is removed from the photosensitive drum 1 and collected by the drum cleaning device 6 as a photosensitive member cleaning means. In addition, at the position facing the tension roller 15, on the outer peripheral surface side of the intermediary transfer belt 7, a belt cleaning device 16 is provided as an intermediary transfer member cleaning means. The toner remaining on the intermediary transfer belt 7 without having been transferred onto the recording material P during secondary transfer (secondary untransferred residual toner) or paper dust adhering to the intermediary transfer belt 7 is removed from the intermediary transfer belt 7 and collected.

Here, in this example, in each image forming portion U, the photosensitive drum 1, the charging roller 2, the developing device 4, and the drum cleaning device 6 as process means acting on the photosensitive drum 1 constitute a process cartridge which can be mounted to and dismounted from the apparatus main assembly of the image forming apparatus 100 as a unit.

2. Structure of Secondary Transfer Portion

Figure 2:
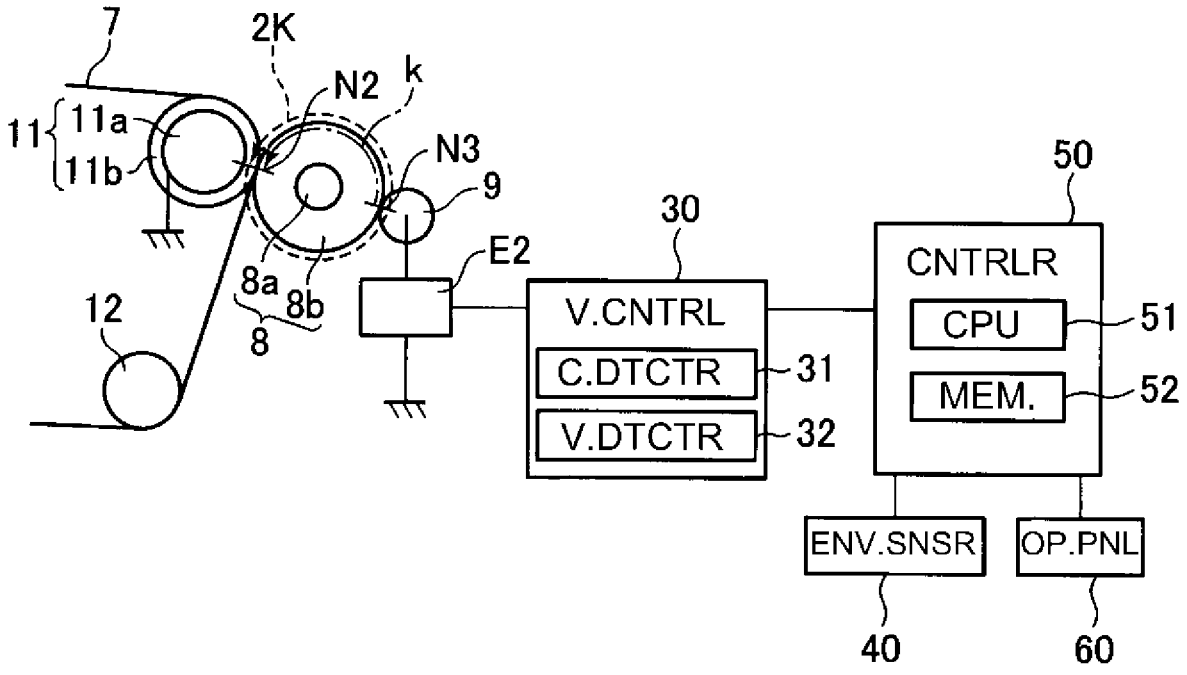
FIG. 2 is a schematic illustration of a structure relating to secondary transfer.

FIG. 2 is a schematic illustration of a structure in the neighborhood of the secondary transfer portion N2 in this embodiment. In this embodiment, the intermediary transfer belt 7 is sandwiched between the secondary transfer counter roller 11 and the secondary transfer roller 8, and a power supply roller 9 as a power supply member (conductive member, conductive roller) capable of supplying electric charge to the secondary transfer roller 8 is in contact with the outer peripheral surface of the secondary transfer roller 8. And, the secondary transfer voltage is applied to the secondary transfer roller 8 through the power supply roller 9. The contact portion between the intermediary transfer belt 7 and the secondary transfer roller 8 is the secondary transfer portion N2. In addition, a contact portion between the secondary transfer roller 8 and the power supply roller 9 is a power feeding portion (power feeding nip) N3. Here, the positions of the secondary transfer portion N2 and the power supply portion N3 are represented by the center positions in the circumferential direction (rotational direction) of the secondary transfer roller 8 and the power supply roller 9, respectively.

The secondary transfer roller (transfer member, transfer rotator) 8 includes a conductive shaft core (core material, core metal) 8*a* and an elastic layer (outer peripheral layer) 8*b* formed on the outer periphery of the shaft core 8*a*. In this embodiment, the shaft core 8*a* is a columnar member made of a metal such as stainless steel which is an electroconductive material. In addition, in this embodiment, the elastic layer 8*b* is formed of a sponge-like or solid elastic material. This example of the rotatable secondary transfer roller 8 includes a layer having ionic conductivity, forms a transfer portion in contact with the image bearing member, and the toner image is transferred from the image bearing member to the recording material passing through the transfer portion. In this embodiment, the thickness of the elastic layer 8*b* is about 4 mm, and the overall diameter (roller diameter) of the secondary transfer roller 8 is about 20 mm. As the elastic material constituting the elastic layer 8*b*, elastomer such as NBR (acrylonitrile butadiene rubber) and EPDM (ethylene propylene rubber), and other synthetic resins are usable. An elastic conductive material (ionic conductive agent) such as a metal complex is added to the elastic material constituting the elastic layer 8*b*, and appropriate conductivity (semiconductive) is provided. Here, as an ionic conductive agent, a semiconductive polymer such as epichlorohydrin rubber may be kneaded with the base material of the elastic layer 8*b*, or a semiconductive polymer and a metal complex may be usable with combination. In addition, an electronic conductive agent (electron conductive agent) such as carbon or metal oxide and an ionic conductive agent may be dispersed in the material of the elastic layer 8*b*. In short, it will suffice if the outer peripheral layer of the secondary transfer roller 8 contains an ionic conductive agent.

The secondary transfer counter roller 11 includes an elastic layer 11*b* of an elastic material such as EPDM, and a metal shaft core (core material, cored bar) 11*a* supporting the elastic layer 11*b*. In this embodiment, the thickness of the elastic layer 11*b* is about 0.5 mm, and the overall diameter (roller diameter) of the secondary transfer counter roller 11 is about 16 mm. The material constituting the elastic layer 11*b* is added with an ionic conductive agent similar to that described above and an electronic conductive agent such as carbon, so that the appropriate conductivity is provided. In addition, it is preferable that the hardness of the elastic layer 11*b* is 70° (measured using an Asker C type measuring instrument, for example). The secondary transfer counter roller 11 is electrically grounded (connected to the ground).

The power supply roller (power supply member, power supply rotatable member) 9 is a metal roller formed in a roller shape with a metal such as SUM or SUS as a conductor. In this embodiment, the diameter of the power supply roller 9 (roller diameter) is about 8 mm. In addition, in this embodiment, the power supply roller 9 is driven to rotate as the secondary transfer roller 8 rotates in a state of being in contact with the surface (outer peripheral surface) of the elastic layer 8*b* of the secondary transfer roller 8. Here, in this embodiment, the roller-shaped member is used as the power supply member, but a brush-like member or a pad-like member, for example can also be used.

As shown in FIG. 2, the image forming apparatus 100 is provided with the secondary transfer power source E2 as the power source (high voltage power source) which supplies power (current or voltage) to the secondary transfer roller 8. The secondary transfer power supply E2 applies, to the secondary transfer roller 8 through the power supply roller 9, the secondary transfer voltage which is a DC voltage having a polarity opposite to the normal charging polarity of the toner (positive polarity in this embodiment), to form an electric field for effecting the secondary transfer of the image onto the secondary transfer portion N2. In this embodiment, the secondary transfer power source E2 is a constant voltage power source. A voltage control circuit 30 is connected to the secondary transfer power source E2. The voltage control circuit 30 controls the voltage which the secondary transfer power source E2 applies to the secondary transfer roller 8 through the power supply roller 9, under the control of the controller 50 which will be described hereinafter. The voltage control circuit 30 is provided with a current detection circuit 31 as current detection means and a voltage detection circuit 32 as voltage detection means.

In the voltage control circuit 30, the voltage applied to the secondary transfer roller 8 by the secondary transfer power source E2 by way of the power supply roller 9 can be controlled at a constant current. That is, in the voltage control circuit 30, when the secondary transfer power source E2 applies the voltage to the secondary transfer roller 8 through the power supply roller 9 the current detection circuit 31 detects the current flowing through the secondary transfer power source E2 (that is, the power supply roller 9, the secondary transfer roller 8, or the secondary transfer portion N2). And, the voltage control circuit 30 can perform the constant-current-control by controlling the output of the secondary transfer power supply E2, such that the current detected by the current detection circuit 31 is close to the target value (substantially constant at the target value). In addition, in the voltage control circuit 30, the voltage applied to the secondary transfer roller 8 by the secondary transfer power source E2 through the power supply roller 9 can be controlled at a constant voltage. That is, in the voltage control circuit 30, when the secondary transfer power supply E2 applies the voltage to the secondary transfer roller 8 through the power supply roller 9, the voltage outputted from the secondary transfer power supply E2 is detected by the voltage detection circuit 32. And, the voltage control circuit 30 can perform the above-descried constant-voltage-control by controlling the output of the secondary transfer power supply E2 such that the voltage detected by the voltage detection circuit 32 is close to the target value (substantially constant at the target value).

3. Action of Power Supply Roller

Figure 3:
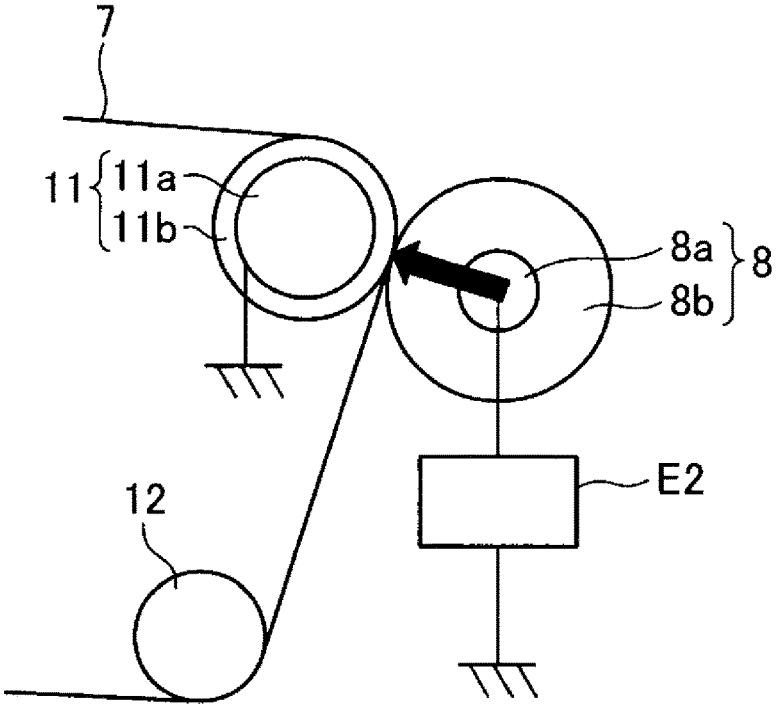
FIG. 3 is a schematic illustration of an electrical path of the secondary transfer portion in a structure in which no power supply roller is provided.

FIG. 3 is a schematic cross-sectional view (taken along a plane substantial perpendicular to the rotation axis of the secondary transfer roller 8) illustrating the movement of charges to the secondary transfer portion N2 in the structure in which a voltage is applied to the shaft core 8*a* of the secondary transfer roller 8, unlike this embodiment. With such a structure, when focusing on the elastic layer 8*b* at a certain position in the circumferential direction of the secondary transfer roller 8, the electric field applied to the position is always oriented in the same direction. Therefore, in this structure, polarization of the ionic conductive agent is produced in the elastic layer 8*b* of the secondary transfer roller 8, with the result that the electrical resistance of the secondary transfer roller 8 increases with the use of the secondary transfer roller 8.

Figure 4:
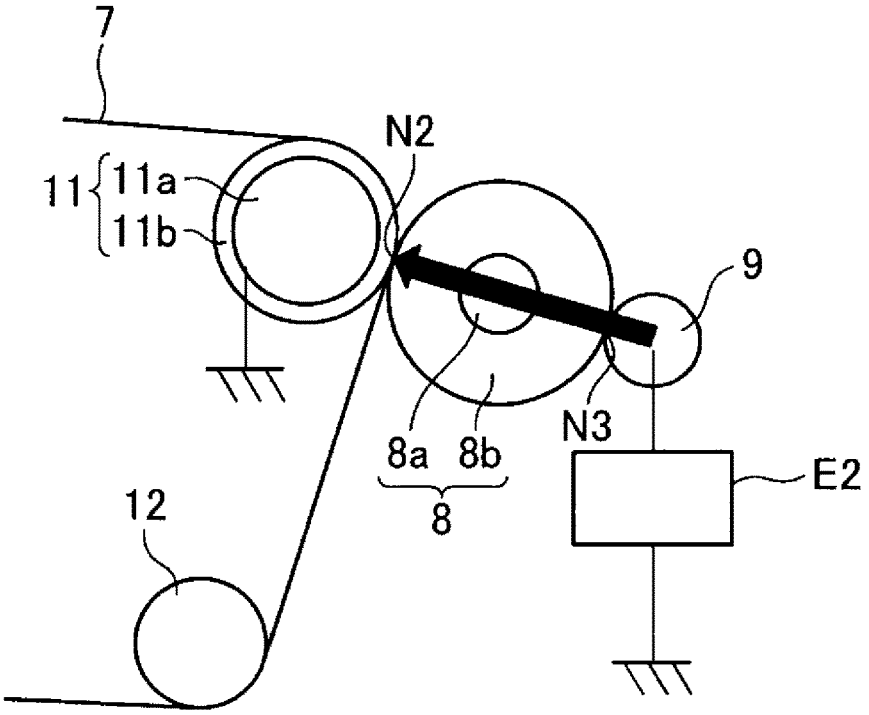
FIG. 4 is a schematic illustration of an electrical path of the secondary transfer portion in a structure in which a power supply roller is provided.

On the contrary, FIG. 4 is a schematic cross-sectional view (a cross-section taken along a plane substantially perpendicular to the rotation axis of the secondary transfer roller 8) explaining the movement of charges from the power supply roller 9 to the secondary transfer portion N2 in this embodiment. In this embodiment, the structure of the image forming apparatus 100 is such that the electric charge supplied from the power supply roller 9 reaches the secondary transfer portion N2 through the shaft core 8*a* of the secondary transfer roller 8. with the structure in which the electric charge supplied from the power supply roller 9 reaches the secondary transfer portion N2 without passing through the shaft core 8*a* of the secondary transfer roller 8, the increase in electrical resistance of the secondary transfer roller 8 attributable to the polarization of the ionic conductive agent in the elastic layer 8*b* of the secondary transfer roller 8 cannot be suppressed. In this embodiment, the secondary transfer opposing roller 8 and the power supply roller 9 face each other with the secondary transfer roller 8 interposed therebetween. In other words, in this embodiment, in a cross-section substantially perpendicular to the rotation axis of the secondary transfer roller 8, the secondary transfer portion N2 and the power supply portion N3 are arranged in phases which are approximately 180 degrees different with respect to the rotation center of the secondary transfer roller 8. By this, when focusing on the elastic layer 8*b* at a certain point in the circumferential direction of the secondary transfer roller 8, the direction of the electric field applied to the point reverses every time the secondary transfer roller 8 rotates half a full rotation. Therefore, the polarization of the ionic conductive agent in the elastic layer 8*b* of the secondary transfer roller 8 can be suppressed, so that an increase in electrical resistance of the secondary transfer roller 8 can be suppressed. Here, the location of the power supply roller 9 will be described hereinafter in more detail in relation to the normal ATVC control in this embodiment.

4. Control System

FIG. 2 is a schematic control block diagram showing a control system of the image forming apparatus 100 of this embodiment. In this embodiment, the image forming apparatus 100 is provided with a control portion controller) 50 as control means. The controller 50 includes a CPU 51 as arithmetic control means, which is a central element for performing arithmetic processing, and a memory (storage medium) 52 such as ROM and RAM as storage means. the ROM stores control programs, data tables obtained in advance, and the RAM, which is a rewritable memory, stores information inputted to the controller 50, detected information, calculation results, and the like. The CPU 51 and memory 52 such as the ROM and the RAM can transfer and read data relative to each other.

In this example, a voltage control circuit 30 for controlling the voltage applied to the secondary transfer roller 8 by the secondary transfer power source E2 under the control of the controller 50 is connected to the controller 50. In addition, an operation portion 60 is connected to the controller 50. the operation portion 60 includes a display as a display means for displaying information to the operator such as users and service personnel; an input portion as an input means for an operator to input information such as various settings to the controller 50. In addition, to the controller 50, an environment sensor 40 is connected as environmental detection means for detecting environmental information relating to at least one of the temperature and humidity inside or outside the image forming apparatus 100. In this embodiment, the environment sensor (temperature/humidity sensor) 40 detects the amount of moisture inside (inside the machine) the image forming apparatus 100 and the temperature outside the machine (outside the machine) to determine relative humidity inside the apparatus. An output signal indicating the detection result of the environment sensor 40 is inputted to the controller 50.

To the controller 50, an image forming signal (image data, control command) or the like is inputted from an image reading device (not shown) of the image forming apparatus 100 or an external device (not shown) such as a personal computer. The controller 50 controls each portion of the image forming apparatus 100 to perform a sequential operation and execute an image forming operation in accordance with the image forming signal.

Here, the image forming apparatus 100 executes a job (print operation) which is started by one start instruction and which is a series of operations for forming and outputting the images on a single or a plurality of recording materials P. In general, the job includes an image forming process, a pre-rotating process, and an inter-sheet process when images are formed on a plurality of recording materials P, and a post-rotating process. The image forming process performs electrostatic image formation to be outputted on the recording material P, the toner image formation, the toner image primary transfer, and the secondary transfer of the image, during the image forming operation (image formation period). More specifically, the timing at the time of image formation is different depending on the position where these electrostatic image forming operations, toner image formation, toner image primary transfer, and secondary transfer steps are performed. The pre-rotation process is carried out in the period during which the preparatory operation before the image forming process is performed from when the start instruction is inputted to when actual image formation starts.

The inter-sheet process is a period corresponding to between a recording material P and a next recording material P when image formation is continuously performed on a plurality of recording materials P (continuous image formation). The post-rotation process is carried out in a period during which the organizing operation (preparing operation) is performed after the image forming process. Non-image-formation period is a period other than the image formation period, and includes the pre-rotation process, the inter-sheet process, the post-rotation process, and the multi-pre-rotation process which is a preparatory operation when the image forming apparatus 100 is turned on or returned from the sleep state.

5. Normal ATVC Control

Figure 5:
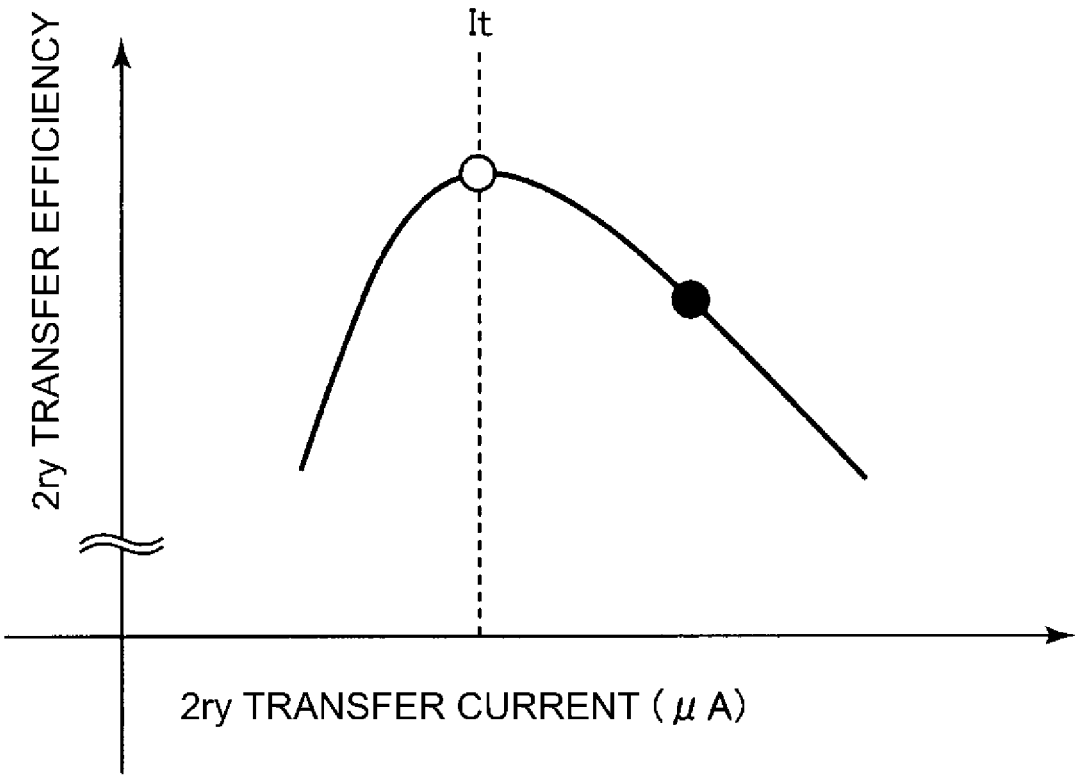
FIG. 5 is a graph explaining a relationship between a secondary transfer current and transfer efficiency.

As described in the foregoing, it is known that the secondary transfer roller 8 using an ionic conductive agent is easily affected by the environment such as the ambient temperature. As shown in FIG. 5, the transfer efficiency (ratio of toner transferred onto the recording material P out of the toner carried on the intermediary transfer belt 7) in the secondary transfer portion N2 generally exhibits a peak (white circle point) at a certain secondary transfer current value. when the electrical resistance of the secondary transfer roller 8 fluctuates with the result that the secondary transfer current value deviates from the peak transfer efficiency (black dot) the transfer efficiency is lowered, and therefore, the quality of the image transferred onto the recording material P may be lowered. under the circumstances, as transfer voltage control (adjusting operation) normal ATVC control (transfer voltage setting mode) is executed. In the normal ATVC control, as a target value of the secondary transfer current value at which the transfer efficiency shows a peak, the voltage value of the secondary transfer voltage during secondary transfer is determined such that the secondary transfer current of the target value flows in the state that the recording material P is interposed in the secondary transfer portion N2. Here, more specifically, the secondary transfer period is a period during which the recording material P is passing through the secondary transfer portion N2.

That is, when there is no toner image or recording material P in the secondary transfer portion N2, a predetermined test current or test voltage is applied from the secondary transfer power source E2 to the secondary transfer roller 8 through the power supply roller 9 in the state that the secondary transfer roller 8 and the intermediary transfer belt 7 are in contact with each other. And, a voltage when a predetermined test current is applied or a current when a predetermined test voltage is applied is detected, current-voltage characteristics that are the relationship between current and voltage are acquired. By this, the information about the electrical resistance of the secondary transfer portion N2 (mainly the secondary transfer roller 8 in this embodiment) is acquired. In particular, in this embodiment, a predetermined test current under constant-current-control is applied, the voltage generated at that time is detected. In addition, on the basis of the acquired current-voltage characteristics, a secondary transfer portion part voltage Vb which is a voltage value corresponding to the target value It is determined. And, Vt=Vb+Vp, which is a voltage value obtained by adding the determined secondary transfer portion part voltage Vb and a preset recording material part voltage Vp is determined as the voltage value of the secondary transfer voltage to be applied to the secondary transfer roller 8 through the power supply roller 9 by the constant-voltage-control during the secondary transfer. Normally, the ATVC control is executed in the pre-rotation process at the start of the job. In addition, the target value It and the recording material part voltage Vp are set in advance depending on the type (basis weight, material, and so on) of the recording material P and the environment (temperature and humidity in this embodiment). Here, in this embodiment, the maximum output (maximum absolute value of the voltage that can be applied) Vm1 of the secondary transfer power supply E2 is set to 6500[V]

Here, the secondary transfer roller 8 uses an elastic material for the elastic layer 8*b*, and the electrical resistance is uneven in the circumferential direction. Therefore, as shown in FIG. 3, in the case of a structure in which a voltage is applied to the shaft core 8*a* of the secondary transfer roller 8, the test voltage or test current is applied over a period of one or more full rotation of the secondary transfer roller 8, and it is necessary to determine the optimal secondary transfer voltage setting on the basis of the average value. This is because in the case of the structure shown in FIG. 3, the current path passes only through the radius of the secondary transfer roller 8, and therefore, unless the detection time required for one or more full rotation of the secondary transfer roller 8 is assured, the electric resistance unevenness of the secondary transfer roller 8 cannot be sufficiently determined. In the case of the structure shown in FIG. 3, by assuring a detection time required for one or more full rotation of the secondary transfer roller 8, the set value of the secondary transfer voltage can be obtained accurately with reducing the influence of uneven electrical resistance in the circumferential direction of the secondary transfer roller 8.

However, as mentioned above, the normal ATVC control causes FCOT delay. In order to perform normal ATVC control for as quickly as possible, it is conceivable to obtain the set value of the secondary transfer voltage on the basis of the current-voltage characteristics of the secondary transfer roller 8 expressed by a linear function equation obtained from two levels of detection results. However, even in this case, in order to reduce the influence of the electrical resistance unevenness in the circumferential direction of the secondary transfer roller 8, a time period equal to or longer than one full turn of the secondary transfer roller 8 is required in order to obtain a detection result for each level, and therefore, the detection time for two or more full rotations of the secondary transfer roller 8 is required as a whole. In addition, the current-voltage characteristics of the secondary transfer roller 8 may have a quadratic relationship, and therefore, even if the set value of the secondary transfer voltage based on the current-voltage characteristic represented by the linear function equation obtained from the two-level detection results is used, there is a case of deviation from the optimum voltage value. Furthermore, the prediction of the output possible bias value of the high-voltage transformer may deviate, with the result that limiter voltage values in the limiter control of the upper limit value and lower limit value of the secondary transfer voltage may not be obtained accurately. Therefore, it is desirable to obtain the current-voltage characteristics expressed by a quadratic or higher function from the detection results of three or more levels, but in this case, a detection time period for at least three full rotations of the secondary transfer roller 8 is required.

In contrast, in this embodiment, as shown in FIG. 4, the image forming apparatus 100 is constituted so as to apply a secondary transfer voltage to the secondary transfer roller 8 through the power supply roller 9. And. in the image forming apparatus 100 in this embodiment, the structure is such that the electric charge supplied from the power supply roller 9 reaches the secondary transfer portion N2 by way of the shaft core 8*a* of the secondary transfer roller 8. In this structure, a current path through the diameter of the secondary transfer roller 8 is used, and therefore, the electric resistance unevenness of the secondary transfer roller 8 can be sufficiently acquired in a detection time less than one full rotation of the secondary transfer roller 8.

More specifically, it is preferable that the power supply roller 9 is disposed at the position described in the following. That is, in a cross-section substantially perpendicular to the rotation axis of the secondary transfer roller 8, the peripheral length (outer peripheral distance) of the secondary transfer roller 8 is 2K, and the distance from the power supply portion N3 to the secondary transfer portion N2 by way of the outer periphery of the secondary transfer roller 8 is k. the following inequality (1) is preferably satisfied.

$$0.8K \leq k \leq 1.2K \quad (1)$$

That is, it is preferable to Place the power supply roller 9 at a position that satisfies the above.

As described above, in this embodiment, the secondary transfer counter roller 8 and the power supply roller 9 face each other with the secondary transfer roller 8 interposed therebetween (more specifically, they are arranged in a range satisfying the above inequality (1)). In other words, in this embodiment, in a cross-section substantially perpendicular to the rotation axis of the secondary transfer roller 8, the secondary transfer portion N2 and the power supply portion N3 are arranged with a phase difference of about 180 degrees with respect to the rotation center of the secondary transfer roller 8 (more specifically, arranged in a range satisfying the above expression (1)).

By this, in the normal ATVC control, the influence of uneven electrical resistance in the circumferential direction of the secondary transfer roller 8 can be sufficiently reduced with the detection time less than that for one full rotation of the secondary transfer roller 8, typically about half a turn (about ½ turn) to acquire the detection results for each level. Therefore, especially when obtaining detection results of 3 levels or more, or even when acquiring detection results of 2 levels or less, the overall detection time can be shortened. In other words, if the overall detection time is the same, more levels of detection results can be acquired.

More specifically, it is preferable that the time less than one full rotation of the secondary transfer roller 8 is as follows. That is, the time for one full rotation of the secondary transfer roller 8 is 2 T, and the time (detection time) for supplying the test current or test voltage per level to the secondary transfer roller 8 is t. At this time, the following inequality (2) is preferably satisfied.

$$0.7\,T \leq t \leq 1.3\,T \quad (2)$$

In addition, it is further preferable that the following inequality (3) is satisfied.

$$0.9\,T \leq t \leq 1.1\,T \quad (3)$$

Here, the time period (detection time) tin which the test current or test voltage per level is applied to the secondary transfer roller 8 is more specifically set to a time period in which the test current or test voltage value rises up to and stabilized at the level suitable for voltage or current sampling. During this detection time t, the value of a predetermined test current or test voltage is allowed to vary within an error range according to the structure of the image forming apparatus 100 and the like.

In this embodiment, the detection time for acquiring the detection result for each level is a time corresponding to about ½ full rotation of the secondary transfer roller 8 (more specifically, a time satisfying the above expression (3)). Even with this short detection time, according to this embodiment, the influence of uneven electrical resistance in the circumferential direction of the secondary transfer roller 8 can be sufficiently reduced.

Next, the operation of the normal ATVC control in this embodiment will be further described.

Figure 6:
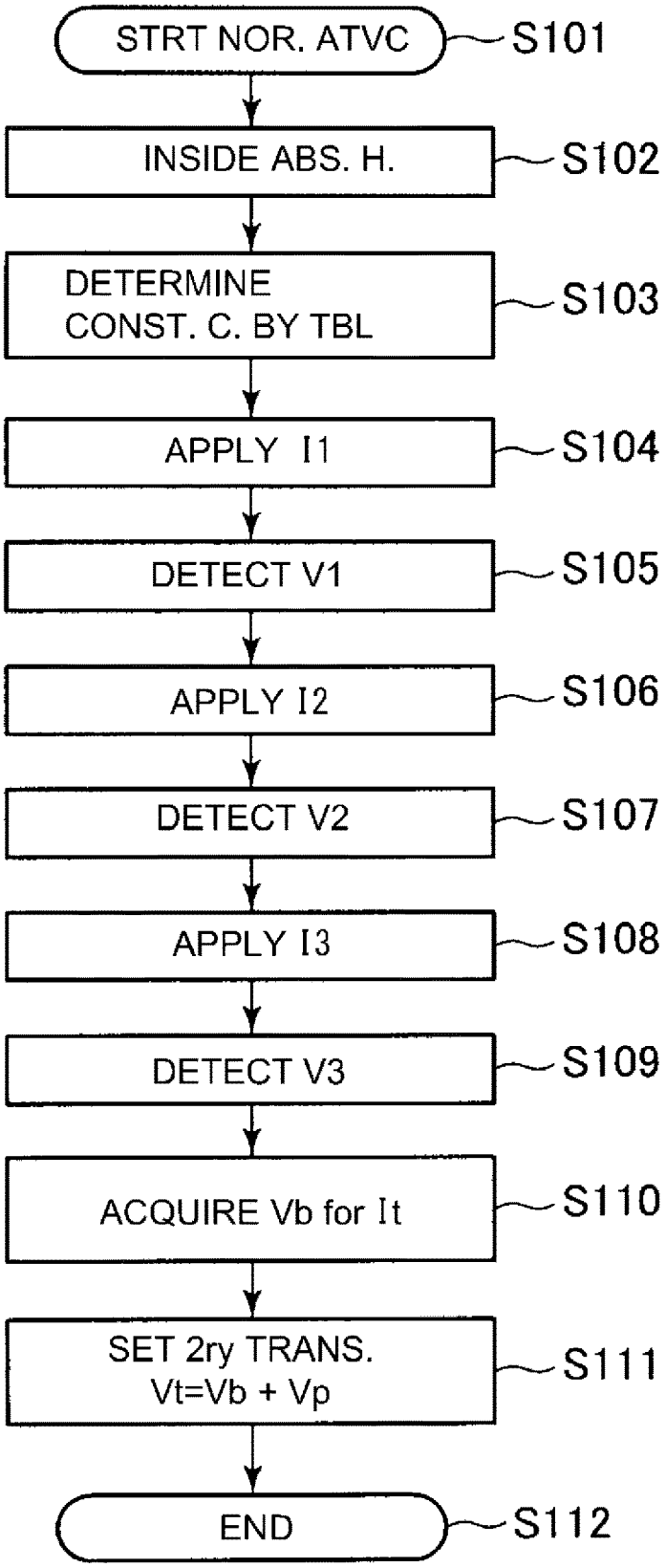
FIG. 6 is a flowchart showing an outline of the normal ATVC control process.

FIG. 6 is a flowchart showing the process of the normal ATVC control according to this embodiment.

Upon receiving the job start instruction, the controller 50 starts normal ATVC control in the pre-rotation process before the recording material P reaches the secondary transfer portion N2 (S101). Next, the controller 50 acquires the detection result of the relative humidity inside the machine by the environment sensor 40 (S102). Here, in this embodiment, the controller 50 calculates the relative humidity inside the machine by the environment sensor 40 on the basis of the amount of moisture in the machine (more specifically, the amount of moisture on the developing device 4) and the temperature outside the machine. Next, the controller 50 determines the value of the test current in normal ATVC control on the basis of the detection result of the relative humidity in the machine and the result of setting the type of recording material P by the operator at the start of the job (S103). In this embodiment, as shown in Table 1, information on the target value It of the secondary transfer current value for each of the full color mode and black single color mode according to the environment (relative humidity) category set for each type of recording material P is set in advance and stored in the memory (ROM) 52. As an example, table 1 shows information on the target value It for plain paper, and in this embodiment, the target value It is set for each of single-sided printing and double-sided printing. Here, the types of recording materials P include any information which can distinguish the recording materials P, such as properties, manufacturers, brands, product numbers, basis weights, thicknesses, sizes, and so on based on general characteristics such as plain paper, thick paper, thin paper, glossy paper, coated paper, and embossed paper. In addition, the controller 50 may determine that a standard recording material P (, for example, plain paper) is used when the type of the recording material P is not designated by the operator. In this embodiment, the controller 50 determines the test currents I1 to I3 so that the target value It falls within the range of test currents I1 to I3 which will be described hereinafter.

TABLE 1

| | R. H. (%) | 0.9 | 3.5 | 6.1 | 8.7 | 12.2 | 15.7 | 18.6 | 21.5 |
|---|---|---|---|---|---|---|---|---|---|
| Fullcolor | Simplex (μm) | 33.8 | 33.1 | 32.4 | 31.7 | 31.0 | 30.3 | 29.6 | 28.9 |
| | Duplex (back side) (μm) | 37.1 | 36.5 | 35.9 | 35.4 | 34.8 | 34.2 | 33.6 | 33.0 |

TABLE 1-continued

| | R. H. (%) | 0.9 | 3.5 | 6.1 | 8.7 | 12.2 | 15.7 | 18.6 | 21.5 |
|---|---|---|---|---|---|---|---|---|---|
| Monochromatic | Simplex (μm) | 23.3 | 22.8 | 22.3 | 21.8 | 21.3 | 20.8 | 20.3 | 19.9 |
| | Duplex (back side) (μm) | 25.5 | 25.1 | 24.7 | 24.3 | 23.9 | 23.5 | 23.1 | 22.7 |

Next, the controller 50 applies a voltage from the secondary transfer power source E2 to the secondary transfer roller 8 through the power supply roller 9 with the constant-current-control on the basis of the detection result of the current detection circuit 31, in order for a predetermined first test current (target current) I1 to flow (S104). In addition, on the basis of the detection result of the voltage detection circuit 32, the controller 50 obtains the average value V1 of the voltage values generated at this time and stores it in the memory (RAM) 52 (S105). In this embodiment, at this time, in order to obtain detection results for each level, a test current is applied over a detection time of less than one full rotation of the secondary transfer roller 8, and the voltage values are detected and averaged. Here, the average value of the voltage values may be an average value of values sampled at a predetermined interval during a detection time less than one full rotation of the secondary transfer roller 8.

Next, the controller 50 applies a voltage from the secondary transfer power source E2 to the secondary transfer roller 8 through the power supply roller 9 by constant-current-control so that the predetermined second test current I2 (>I1) flows, on the basis of the detection result of the current detection circuit 31, (S106). In addition, based on the detection result of the voltage detection circuit 32, the controller 50 obtains the average value V2 of the voltage value generated at this time, and the result is stored in the memory (RAM) 52 (S107).

Next, the controller 50 applies a voltage from the secondary transfer power source E2 to the secondary transfer roller 8 through the power supply roller 9 by constant-current-control so that the predetermined third test current I3 (>I2) flows, on the basis of the detection result of the current detection circuit 31 (S108). In addition, on the basis of the detection result of the voltage detection circuit 32, the controller 50 obtains the average value V3 of the voltage value generated at this time, and the result is stored in the memory (RAM) 52 (S109).

Figure 7:
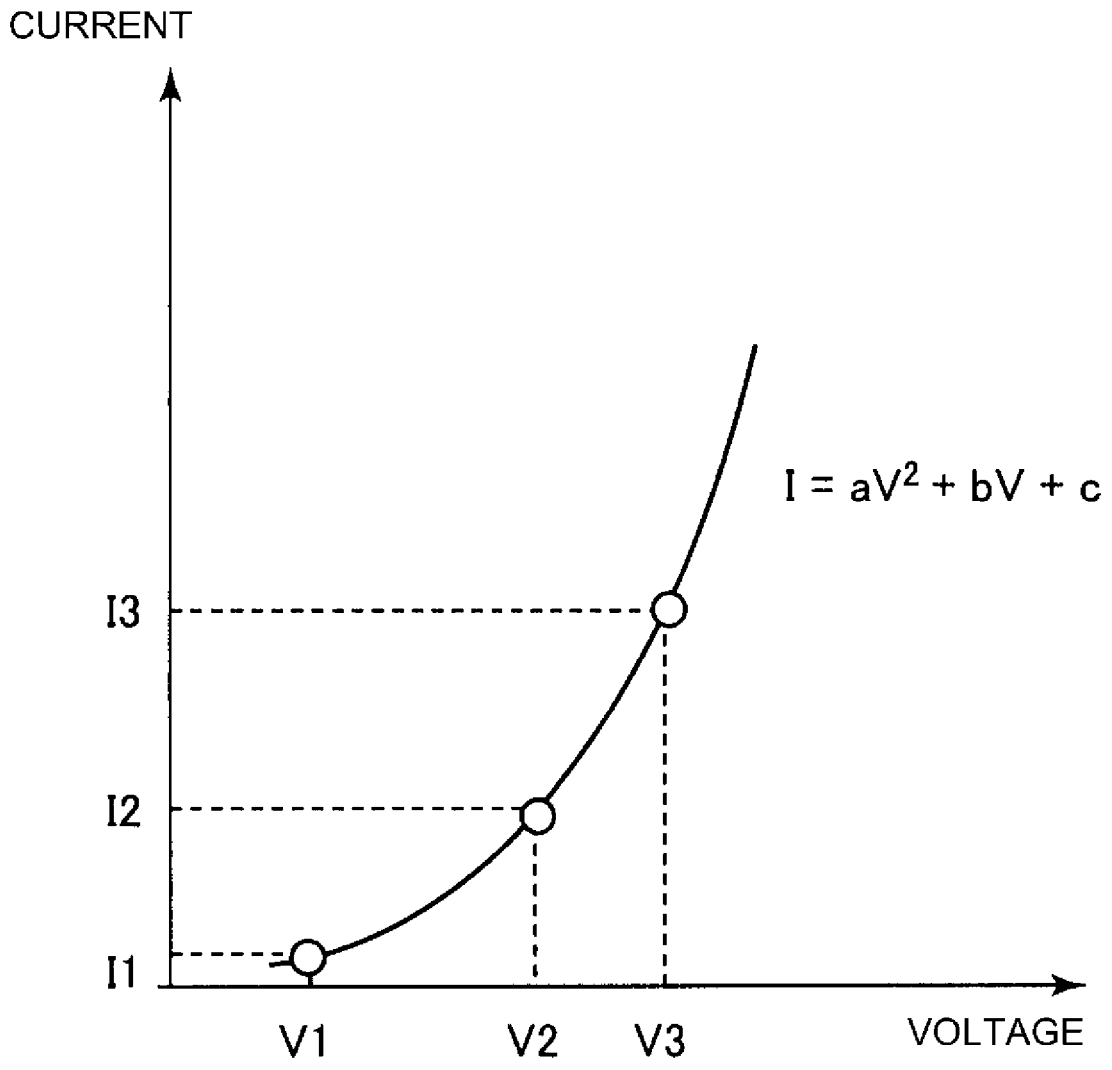
FIG. 7 is a graph showing the current-voltage characteristics obtained by ATVC control.

Next, based on the acquired I1, I2, I3, V1, V2, V3, the controller 50 obtains the secondary transfer portion part voltage Vb corresponding to the target value It, and it is stored in the memory (RAM) 52 (S110). In this embodiment, as shown in FIG. 7, the controller 50 approximates the acquired relationship between I1, I2, I3, V1, V2, and V3 (current-voltage characteristics) by a quadratic expression. then, the controller 50 applies the target value It to the obtained quadratic expression to obtain the secondary transfer portion part voltage Vb corresponding to the target value It, and the result is stored in the memory (RAM) 52. Here, the method of obtaining the current-voltage characteristics expressed by a quadratic function from the acquired three-level current and voltage detection results is arbitrary, but in the present embodiment, it is obtained by the least square method. And, the controller 50 adds the recording material part voltage Vp to the obtained secondary transfer portion part voltage Vb, to determine the set value of secondary transfer voltage (target voltage) Vt to be applied by constant-voltage-control during secondary transfer (S111). Recording material part voltage Vp information is preset in accordance with the type of recording material P and environmental conditions and so on, and is stored in the memory (ROM) 52. The determined secondary transfer voltage set value Vt is stored in the memory (RAM) 52 as a backup value and is used as the secondary transfer voltage set value to be applied by the constant-voltage-control when image formation is started. Thereafter, the controller 50 completes the normal ATVC control (S112).

Here, in this embodiment, in normal ATVC control, the set value of the secondary transfer voltage is determined using a quadratic equation on the basis of three levels of detection results, but it is not limited to this example. For another example, from the standpoint of prioritizing the reduction of detection time, the set value of the secondary transfer voltage may be determined using the linear expression on the basis of the two levels of detection results. In addition, from the standpoint of prioritizing improvement in the detection accuracy of the current-voltage characteristics of the secondary transfer roller 8, the set value of the secondary transfer voltage may be obtained using a quadratic expression on the basis of the detection results of four levels or more. However, in many cases, current-voltage characteristics can be obtained with sufficient accuracy on the basis of detection results of 10 levels or less.

As described above, in this embodiment, the image forming apparatus 100 includes detection units 31 and 32 which detects the voltage at the time when the current is supplied to the transfer roller 8 or the current at the time when the voltage is supplied to the transfer roller 8. In addition, the image forming apparatus 100 includes a controller 50, which supplies, during non-image formation period, the predetermined test current or test voltage of one or more levels from the power source E2 to the transfer roller 8 through the power supply member 9, and adjusts the transfer voltage setting for the image transfer, on the basis of the detection results of the detection means 31 and 32 when supplying the test current or the test voltage for executing the adjusting operation. And, when the peripheral length of the transfer roller 8 is 2K and the distance from the power supply portion N3 to the transfer portion N2 along the outer periphery of the transfer roller 8 is k the power supply roller 9 is disposed at a position satisfying the following inequality, in a cross-section substantially perpendicular to the rotation axis of the transfer roller 8: $0.8K \leq k \leq 1.2K$. In addition, in the adjusting operation by the controller 50, the time for supplying the test current or test voltage per level to the transfer roller 8 is less than the time taken for the transfer roller 8 to make one full rotation. That is, in the adjusting operation of the controller 50, when the time required for the transfer roller 8 to make one full rotation is 2 T, the time t for supplying the test current or test voltage per level to the transfer roller 8 satisfies $0.7\ T \leq t \leq 1.3\ T$. In addition, preferably, in the adjusting operation of the controller 50, the time t for supplying the test current or test voltage per level to the transfer roller 8 satisfies $0.9\ T \leq t \leq 1.1\ T$. In this embodiment, the controller 50 performs an adjusting operation during a period from the input of the image formation start instruction to the start of image formation, and supplies a test current or test voltage at each of three levels or more to the transfer roller 8 in the adjusting operation.

According to this embodiment, the time required to acquire the detection result for each level in the normal ATVC control can be set to a time less than one full rotation of the secondary transfer roller 8. Therefore, according to this embodiment, the overall detection time in the normal ATVC control can be shortened, or if the overall detection time is equal, the number of test voltage or test current levels applied during the time can be increased. Here, in this embodiment, the process speed (corresponding to the peripheral speed of the intermediary transfer belt 7) is 320 mm sec. In addition, in this embodiment, the time required for about ½ full rotation of the secondary transfer roller 8 is about 0.1 msec. That is, according to this embodiment, it is possible, for example, the current-voltage characteristics expressed by a quadratic function is obtained from the detection results of three or more levels, and the secondary transfer voltage is set to the optimum voltage value with high accuracy, while suppressing FCOT delay. In addition, the accuracy of prediction of the bias value which can be outputted from the high-voltage transformer is improved, and the limiter voltage value in the limiter control of the upper limit value and the lower limit value in the secondary transfer voltage can be obtained with high accuracy. That is, according to this embodiment, the transfer voltage control time can be shortened with the same transfer voltage control accuracy, or the transfer voltage control accuracy can be improved with the same control time.

Embodiment 2

Next, another embodiment of the present invention will be described. The basic structure and operation of the image forming apparatus of this embodiment are the same as those of the image forming apparatus of Embodiment 1. Therefore, in the image forming apparatus of this embodiment, elements having the same or corresponding functions or structures as those of the image forming apparatus of Embodiment 1 are denoted by the same reference numerals as those of Embodiment 1, and detailed description thereof is omitted for simplicity.

In Embodiment 1, the normal ATVC control executed in the pre-rotation process is performed, but in this embodiment, the inter-sheet ATVC control executed in the inter-sheet period is performed.

Here, the description will be made as to influence to secondary transfer roller 8 during the continuous image formation in which consecutive image formations on multiple recording materials P are carried out. In the continuous image formation job, the images are sequentially formed and outputted on the recording material P fed sequentially from the recording material container such as a recording material cassette. When performing continuous image formation, the normal ATVC control described in Embodiment 1 is executed, in the pre-rotation process at the start of the job, and the voltage value of the secondary transfer voltage at the time of secondary transfer (when the recording material P passes through the secondary transfer portion N2) is determined. And, during continuous image formation, the voltage value of the secondary transfer voltage determined in the pre-rotation process is commonly used for a plurality of recording materials P which pass through the secondary transfer portion N2.

Additionally, during continuous image formation, the temperature inside the casing of the image forming apparatus 100 rises due to heat generated by a fixing device (not shown) or the like. In addition, friction heat is generated by sliding between the shaft core 8*a* of the secondary transfer roller 8 and bearing members (not shown). Therefore, during continuous image formation, the temperature of the secondary transfer roller 8 rises with time, and the current-voltage characteristics change, and in particular, the electric resistance of the elastic layer 8*b* changes. In addition, the electrical resistance of the secondary transfer roller 8 may change also due to the changes in humidity, the contamination on the surface of the secondary transfer roller 8 resulting from continuous use, and the like.

Therefore, if the set value of the secondary transfer voltage is constant during continuous image formation, the secondary transfer current may deviate from the target value It due to changes in the electrical resistance of the secondary transfer roller 8, as shown in parts (a) and (b) of FIG. 8. In the example shown in parts (a) and (b) of FIG. 8, due to the temperature rise during continuous image formation, the electrical resistance of the secondary transfer roller 8 decreases, such that the secondary transfer current during the secondary transfer for the fifth recording material P is larger than the target value It by ΔI. In this case if the secondary transfer current deviates from the peak transfer efficiency (black dot in FIG. 3), and the transfer efficiency is lowered, and the quality of the image transferred onto the recording material P may be lowered.

Under the circumstances, it is preferable that during continuous image formation, the inter-sheet ATVC control is executed in the inter-sheet process at a predetermined timing, to correct the secondary transfer voltage setting. At this time, as shown in FIG. 3 in the case of a structure in which a voltage is applied to the shaft core 8*a* of the secondary transfer roller 8, if the time between the paper processes is short and the detection time for one rotation of the secondary transfer roller 8 cannot be assured, what has been done is as follows. That is, the setting value of the secondary transfer voltage is corrected on the basis of the average value of the detection results in the inter-sheet process, by which the influence of uneven electrical resistance in the circumferential direction of the secondary transfer roller 8 is reduced. In this case, if an attempt is made to detect multiple levels in the inter-sheet period, it is necessary that the detection is performed in multiple inter-sheet periods for each level, and the detection results corresponding to one full rotations of the secondary transfer roller 8 in multiple inter-sheet periods for each level are averaged. However, in the conventional method of reducing the influence of the uneven electrical resistance in the circumferential direction of the secondary transfer roller 8 on the basis of the average value of the detection results in a plurality of inter-sheet processes when the inter-sheet process time is short, the influence of uneven electrical resistance in the circumferential direction of the secondary transfer roller 8 cannot be sufficiently reduced, in some cases. In addition, in such a conventional method, when performing multiple levels of detection in the inter-sheet period, the detection time in the inter-sheet period required for each level is longer. On the other hand, it would be considered to extend the inter-sheet process to reduce the influence of uneven electrical resistance in the circumferential direction of the secondary transfer roller 8, but the detection time is longer, again also in this case. In the inter-sheet ATVC control, the toner (fog toner) which may have adhered to the area corresponding to the inter-sheet space on the intermediary transfer belt 7 is actively attracted to the secondary transfer roller 8 by applying a voltage to the secondary transfer roller 8. Therefore, if the detection time in the inter-sheet ATVC control is longer, the backside of the recording material P may be generated during subsequent image formation in some cases, due to the fog toner adhering to the secondary transfer roller 8.

In contrast, in the image forming apparatus 100 according to this embodiment, a secondary transfer voltage is applied to the secondary transfer roller 8 through the power supply roller 9, as shown in FIG. 4. And, the image forming apparatus 100 in this embodiment is constituted such that the electric charge supplied from the power supply roller 9 reaches the secondary transfer portion N2 by way of the shaft core 8*a* of the secondary transfer roller 8. Therefore, as explained in Embodiment 1, the unevenness of the electric resistance of the secondary transfer roller 8 can be acquired sufficiently with the detection time period less than that corresponding to one full rotation of the secondary transfer roller 8. Therefore, in the ATVC control between the adjacent sheets, the influence of uneven electrical resistance, in the circumferential direction, of the secondary transfer roller 8 can be sufficiently reduced, with the detection time less than one full rotation of the secondary transfer roller 8, typically about half a turn (about ½ turn) to obtain the detection results for each level. Therefore, even if the time period of the inter-sheet process is short, the influence of the electrical resistance unevenness, in the circumferential direction, of the secondary transfer roller 8 can be sufficiently reduced without extending the inter-sheet period. Typically, in order to detect the uneven electrical resistance in the circumferential direction of the secondary transfer roller 8, it is not necessary that the detection is performed in a plurality of inter-sheet processes for each level, and the detection results are averaged. Therefore, even when acquiring detection results of 3 levels or more, the overall detection time can be further shortened if two levels or one level detection results are obtained.

Next, the operation of the inter-sheet ATVC control in this embodiment will be further described. FIG. 9 is a flowchart showing an outline of the process of the inter-sheet ATVC control in this embodiment. Here, in this embodiment, when the number of images formed reaches the specified number of images during continuous image formation, the inter-sheet ATVC control is executed in the inter-sheet period between the current image and the next image to be formed.

When the timing to execute the inter-sheet ATVC control comes, the controller 50 starts the inter-sheet ATVC control (S201) during the inter-sheet period (when the non-image area between the image area and the next image area on the intermediary transfer belt 7 passes through the secondary transfer portion P). Here, the image area on the intermediary transfer belt 7 is an area where a toner image to be transferred onto one recording material P on the intermediary transfer belt 7 can be formed, and the non-image area on the intermediary transfer belt 7 is an area other than the image area on the intermediary transfer belt 7. Next, the controller 50 determines the value of the test current in the inter-sheet ATVC control on the basis of the relative humidity in the machine detected during the pre-rotation process, and the result of setting the type of recording material P by the operator at the start of the job (S202). In this embodiment, similarly to the normal ATVC control described in Embodiment 1, the controller 50 determines test currents I1 to I3 which will be described hereinafter.

Accordingly, the controller 50 executes the processing of S203 to S211 of FIG. 9 which is the same as the processing of S104 to S112 of FIG. 6. In this embodiment, one level of detection is performed for each inter-sheet process tp determine the set value of the secondary transfer voltage in the same way as normal ATVC control on the basis of the detection results of multiple levels (three levels in this example) detected in multiple inter-sheet processes. For example, after it is determined that the inter-sheet ATVC control is to be started, the first level detection is performed in the inter-sheet process between the first and second sheets, the second level of detection is performed in any of the inter-sheet periods between the second and fourth sheets, and the third level detection is performed in any of inter-sheet periods between the fourth and sixth sheets. The newly determined secondary transfer voltage setting value Vt is overwritten and stored in the memory (RAM) 52 as a backup value, and it is used as a set value for the secondary transfer voltage applied by constant-voltage-control during subsequent image formation in continuous image formation.

In this embodiment, as in Embodiment 1, the process speed (corresponding to the peripheral speed of the intermediary transfer belt 7) is 320 mm/sec. And, when A4 size recording material P is used, the time required for one sheet to pass through the secondary transfer portion N2 is about 0.3 msec. On the other hand, the time for about ½ full rotation of the secondary transfer roller 8 is about 0.1 msec, and the time required for the rise and fall of the voltage of the secondary transfer power source E2 is 0.1 msec. Here, if the time period between sheets is even shorter, it is satisfactory if the detection is performed in multiple inter-sheet processes for each level, and the secondary transfer voltage is set based on the result of averaging the detection results. Even in that case, the detection time in the inter-sheet process required for each level may be a time corresponding to about ½ full rotation of the secondary transfer roller 8.

According to this embodiment, without using a method to reduce the influence of uneven electrical resistance in the circumferential direction of the secondary transfer roller 8 on the basis of the average value of the detection results in a plurality of inter-sheet processes, it is possible to reduce the influence of the electrical resistance unevenness and perform the inter-sheet ATVC with high accuracy. In addition, even when using the method of reducing the influence of uneven electrical resistance in the circumferential direction of the secondary transfer roller 8 on the basis of the average value of the detection results in a plurality of inter-sheet processes, the bias voltage application time required per level can be reduced (about half). For this reason, the percentage of time that can be applied to one sheet-to-paper process for the bias voltage application time required per level can be increased, and the influence of uneven electrical resistance in the circumferential direction of the secondary transfer roller 8 can be reduced. By this, depending on the change in electrical resistance (current-voltage characteristics) of the secondary transfer roller 8 which occurs during continuous image formation, it is possible to suppress a decrease in transfer efficiency during continuous image formation, by controlling the secondary transfer current to an optimum value with high accuracy at short intervals. In addition, the set value of the secondary transfer voltage can be corrected accurately without extending the inter-sheet process, and therefore, it is effective to suppress the attracting of fog toner to the secondary transfer roller 8 when executing the inter-sheet ATVC control, and the back side contamination of the recording material P during subsequent image formation can be suppressed.

Here, in the ATVC control between sheets in this embodiment, the set value of the secondary transfer voltage is corrected using the quadratic equation obtained on the basis of the three levels of detection results, but the present invention is not limited to this example. For example, prioritizing the reduction of detection time, the set value of the secondary transfer voltage may be obtained using the linear expression obtained on the basis of the two levels of detection results. In addition, the current-voltage characteristics acquired by the normal ATVC control may be corrected, and the set value of the secondary transfer voltage may be determined based on the corrected current-voltage characteristics, as follows. That is, in the ATVC control between the sheets, the secondary transfer portion part voltage Vb corresponding to the target value is determined on the basis of the detection result of a level lower than in the normal ATVC control (for example, 2 levels or 1 level). In addition, the current-voltage characteristics obtained by the normal ATVC control is corrected on the basis of the ratio between the target value It and the current value obtained by applying the secondary transfer portion part voltage Vb obtained by the inter-sheet ATVC control to the current-voltage characteristic acquired by the normal ATVC control executed in advance. In addition, by applying the target value It to the corrected current-voltage characteristics, a secondary transfer portion part voltage Vb corresponding to the target value It in the corrected current-voltage characteristic is obtained. And, the setting value of the secondary transfer voltage can be obtained by adding the secondary transfer portion part voltage Vb and the recording material part voltage Vp. As described above, by reducing the level of test current or test voltage in the inter-sheet ATVC control as compared to the normal ATVC control, it is possible to shorten the detection time in the inter-sheet ATVC control, thus further suppressing the back side contamination of the recording material P due to the toner adhering to the secondary transfer roller 8.

As described above, in this example, the controller 50 performs the adjusting operation during the period and applies at least one level of the specified test current or test voltage for a period of 0.7T or more and 1.3T or less during each period, without changing the length of the period in which the area between the image area on the image bearing member and the next image area passes through the transfer portion N2 in continuous image formation in which images are continuously formed on a plurality of recording materials P. Here, the controller 50 can carry out the adjusting operation in the first period from when the image formation start instruction is input to when image formation starts, and in the second period in which the region between the image region on the image bearing member and the next image region in the continuous image formation in which images are continuously formed on the plurality of recording materials P passes through the transfer portion N2. And, the controller 50 supplies three or more levels of test current or test voltage to the transfer roller 8 in the adjusting operation executed in the first period, and in the adjusting operation executed in the second period, the controller 50 supplies a smaller number of levels (than in the first period) of the test current or voltage to the transfer roller 8.

[Others]

In the foregoing, this invention has been described according to the specific Embodiment, but the present invention is not limited to the above-described embodiments.

In this embodiment, an example in which the secondary transfer counter roller 11 is electrically grounded (connected to the ground) and the transfer current is supplied to the secondary transfer roller 8 through the power supply roller 9 has been described, but the present invention is not limited to such an example. For example, the structure may be such that the power supply roller 9 is electrically grounded (connected to the ground), and the secondary transfer power source E2 is connected to the secondary transfer counter roller 11, and transfer current is supplied from the secondary transfer counter roller 11 to the secondary transfer roller 8. in this case as well, each time the secondary transfer roller 8 makes a half full-rotation, the direction of the transfer current reverses, and therefore, the effect of suppressing the increase in resistance of the secondary transfer roller 8 can be provided. In any event, the secondary transfer power supply E2 supplies a transfer current to the secondary transfer roller 8 by passing a current through a current path formed between the intermediary transfer belt 7 and the power supply roller 9 by way of the secondary transfer roller 8.

In the above-described embodiments, the present invention is applied to the secondary transfer portion, but the present invention is not limited to such an example. The present invention is applicable to a monochromatic image forming apparatus including only a single image bearing member, for example. In this case, the present invention can be applied to a transfer portion which transfers a toner image from the image bearing member to a recording material. Here, this image bearing member may be, for example, a drum-like or belt-like photosensitive member or an electrostatic recording dielectric member.

In addition, in the above-described embodiment, transfer voltage is controlled by the constant current fashion, but the present invention can be applied even when the transfer voltage is controlled at a constant voltage fashion. In this case in transfer voltage control, on the basis of the acquired current-voltage characteristics, the target value (initial value) of the voltage necessary to provide the target current value during secondary transfer, the target value of the current necessary to provide the target voltage value during secondary transfer, and so on can be determined.

In addition, in the above-described embodiment, which the ATVC control is usually executed in the pre-rotation process but, it may be executed in a pre-multi-rotation process or a post-rotation process. In addition, the normal ATVC control is not limited to that executed in each pre-rotation process, pre-multi-rotation process, or post-rotation process, but it can be executed at a predetermined timing (based on the elapse of time since the previous execution, environmental change, replacement of portions related to image formation, and so on). In addition, in the above-described embodiment, the inter-sheet ATVC control is performed every predetermined number of images formed during continuous image formation but, it can be executed at a predetermined timing based on an arbitrary index such as the elapse of time since the previous execution or environmental changes or the like. It may be executed each time of the interval between adjacent sheets.

While the present invention has been described with reference to exemplary embodiments, it is to be understood that the invention is not limited to the disclosed exemplary embodiments. The scope of the following claims is to be accorded the broadest interpretation so as to encompass all such modifications. And equivalent structures and functions.

This application claims the benefit of Japanese Patent Application No. 2018-248743 filed on Dec. 28, 2018, which is hereby incorporated by reference herein in its entirety.

What is claimed is:

1. An image forming apparatus comprising:

an image forming portion configured to form a toner image;

a belt on which the toner image formed by the image forming portion is transferred;

a transfer roller abutting an outer peripheral surface of the belt and forming a transfer nip for transferring the toner image formed on the belt to a recording material;

an opposing roller opposing the transfer roller with the belt disposed therebetween and forming the transfer nip in cooperation with the transfer roller;

a conductive roller configured to contact the outer peripheral surface of the transfer roller on a side opposite to the transfer nip;

a power source configured to pass a transfer current through a current path formed from the conductive roller to the opposing roller by way of the transfer roller;

a detection portion configured to detect voltage or current output by the power source; and a controller configured to execute, in a preparation period from when an image formation start instruction is inputted to when a transfer of the toner image to the recording material is started, an operation in a setting mode for setting the voltage or the current to be supplied by the power source when the toner image is transferred to the recording material on the basis of a detection result detected by the detection portion while the power source supplies a test voltage or a test current, wherein the controller controls said power source to supply the test voltage or the test current at a plurality of levels in the operation of the setting mode and controls the power source so as to satisfy:

$$0.7T \leq t \leq 1.3T,$$

where 2T is time required for one full rotation of the transfer roller and t is time during which the power source supplies the test current or the test voltage at each level in the operation of the setting mode.

2. An apparatus according to claim 1, wherein the controller controls the power source so as to satisfy $0.9T \leq t \leq 1.1T$.

3. An apparatus according to claim 1, wherein the controller operates the power source to supply not less than three levels of the test current or the test voltage to the transfer roller in the operation of the setting mode.

4. An apparatus according to claim 1, wherein when a circumferential length of the transfer roller is 2K and a distance measured in a rotational direction along an outer periphery of the transfer roller from a contact portion where the conductive roller contacts the transfer roller to the transfer nip is k, $0.8\ K \leq k \leq 1.2\ K$ is satisfied.

5. An apparatus according to claim 1, wherein the transfer roller includes a conductive shaft core and an elastic layer formed on the outer periphery of the shaft core and the power source is configured to pass the transfer current through a first current path between the shaft core and the conductive roller and a second current path between the shaft core and the transfer nip.

6. An apparatus according to claim 1, wherein the controller performs constant-current control so as to supply a predetermined target current to the transfer roller in the operation of the setting mode, and sets the voltage to be supplied by the power source when the toner image is transferred to the recording material based on the detection result of the detection portion detected during the constant-current control.

* * * * *